United States Patent [19]

Stark

[11] Patent Number: 4,568,079

[45] Date of Patent: Feb. 4, 1986

[54] INFANT PLAY RING AND ASSOCIATED METHOD

[76] Inventor: Ruth Stark, 339 Mill River Rd., Oyster Bay, N.Y. 11771

[21] Appl. No.: 602,609

[22] Filed: Apr. 20, 1984

[51] Int. Cl.[4] ..... A63G 1/12; A63G 1/14; A63B 21/10

[52] U.S. Cl. ..... 272/144; 272/33 R; 272/145; 272/146

[58] Field of Search ..... 272/144, 128, 93, 28 R, 272/145, 146, 115, 33 A, 33 R; 128/71; 5/61, 109, 110, 120, 122, 123; 297/349

[56] References Cited

U.S. PATENT DOCUMENTS

| | | | |
|---|---|---|---|
| 2,467,338 | 4/1949 | Sellards | 272/33 R |
| 2,697,478 | 12/1954 | McKinney | 272/33 R |
| 2,930,430 | 3/1960 | Bloom | 272/144 |
| 2,988,358 | 6/1961 | Mills | 272/28 R |
| 3,604,722 | 9/1971 | Boley | 272/1 R X |
| 3,886,607 | 6/1975 | Dunn | 272/1 R X |

FOREIGN PATENT DOCUMENTS 1603173 1/1970 Fed. Rep. of Germany .

*Primary Examiner*—Richard J. Apley
*Assistant Examiner*—Kathleen D'Arrigo
*Attorney, Agent, or Firm*—Roberts, Spiecens & Cohen

[57] ABSTRACT

An infant play ring comprising a support of concave shape on which an infant can be disposed in supine position. The support has a central region in an arrangement such that the infant on the support extends across the central region. A rotatable turntable is provided at the central region of the support for supporting the infant with capability of rotating on the turntable relative to the support in supine position.

12 Claims, 2 Drawing Figures

INFANT PLAY RING AND ASSOCIATED METHOD

FIELD OF THE INVENTION

The invention relates to an infant play ring which will serve as an infant stimulation machine adaptable for use by infants up to approximately five months of age. The infant play ring is adapted as a feedback machine for infants to provide a visual, oratory and tactile response to hand and foot activity by the infant.

The invention also relates to a method of providing visual, tactile and oratory response for an infant.

BACKGROUND

Known in the art are various types of child development devices in which children are supported on a rotatable seat to undergo turning movement relative to a support. Examples of the known construction can be found in U.S. Pat. Nos. 1,656,637 (Hudson); 3,171,651 (Merdich et al); 3,454,272 (Elkington et al) and 3,749,399 (Fedor et al).

The known devices are intended for use with children of advanced age and rely upon the ability of the child to self-assume a seated position and to be capable of initiating a rotating movement.

Recently, there has been found need for developing visual, oratory and tactile response to hand and foot activity of infants up to approximately five months of age.

To the best of my knowledge, there are no machines which will satisfactorily achieve this purpose.

SUMMARY OF THE INVENTION

An object of the invention is to provide a method and apparatus for serving as a feedback machine for infants to provide a visual, oratory and tactile response to hand and foot activity by the infant.

A further object is to provide a method and machine by which infant stimulation will be achieved for infants up to approximately five months of age.

A further object of the invention is to provide a method and machine which is particularly suitable for use by infants up to approximately five months of age by not requiring the infant to be required to self-assume a seated position.

Yet, another object of the invention is to provide a method and apparatus by which the stimulation of the visual, oratory and tactile responses to hand and foot activity by the infant will be achieved with the infant in a supine position.

In accordance with the above and further objections of the invention, there is provided an infant play ring which comprises a support means on which an infant can be disposed in supine position, said support means being of concave shape and having a central region in an arrangement such that the infant, when disposed on the support means, extends across the central region. A rotatable turntable means is mounted at the central region of the support means for supporting the infant with capability of rotating on the turntable relative to the support means while in supine position.

In accordance with a feature of the invention, the support means comprises a shell of flexible material including a peripheral ring portion which is suspended from a rigid ring. The turntable is in the form of a rotatable seat disposed at the inner surface of the shell substantially flush therewith.

In accordance with the method of the invention, the infant is placed in supine position on the rotatable turntable with the legs and arms of the infant extending radially outside the turntable and the shell provides a countersupport for the infant insofar that the infant can spin himself or herself around the countersupport while on the turntable in supine position.

More particularly, the spinning movement of the infant is achieved by the hand and foot activity of the infant which provides the visual, oratory and tactile responses for the infant.

Further objects and features of the invention will become evident from the description of a specific embodiment thereof illustrated in the appended drawing.

DETAILED DESCRIPTION

Figure 1:
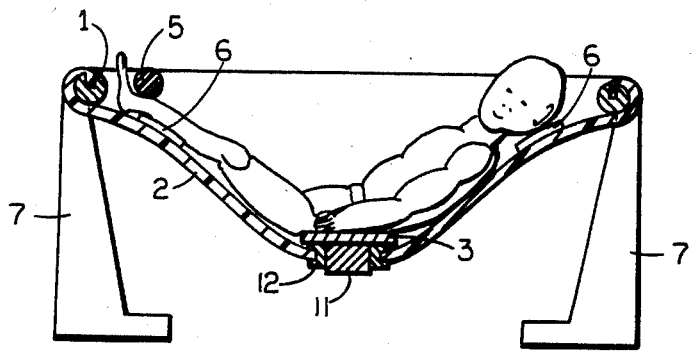
FIG. 1 is a side elevational view, partly in section, showing the infant play ring according to my invention.
Figure 2:
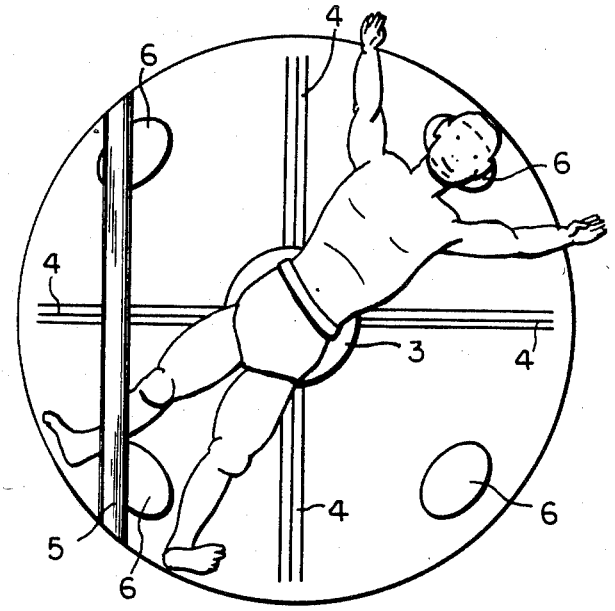
FIG. 2 is a plan view thereof.

In the drawing is shown one embodiment of an infant play ring which comprises a circular ring 1 of rigid material from which is suspended a support means 2 in the form of a shell of low friction flexible material, such as relatively heavy gauge plastic or the like. The suspended shell 2 is concave and an infant B can be placed in comfortable, supported relation within the shell in supine position. The shell 2 carries a rotatable turntable 3 in its central region which serves as a seat on which the backside of the infant can be placed and which enables the infant to pivot about the suspended shell 2 in various angular positions.

The turntable 3 is rotatably supported in the shell by the provision of the rotatable support of a shaft 11 depending from the turntable in a sleeve 12 fixed in the center of the shell 2. The turntable 3 is disposed at the inner surface of the shell 2 substantially flush therewith. The turntable 3 is relatively rigid compared to the shell and it has a substantially flat upper surface. The turntable is dimensioned as a fraction of the outer diameter of the shell in order to support the backside of the infant while his or her legs, torso, arms and head extend outside the turntable to enable the infant to spin himself or herself around the shell.

A radial ribbing 4 is provided at a number of locations on the shell 2 to provide counter-support for the hands and feet of the infant so that the infant can spin himself or herself around the shell 2 while resting on the rotatable seat 3.

In use, the infant is placed in supine position with his or her backside on the turntable seat 3 and with the infant's legs extending upwards and radially in one direction and with the infant's torso and head extending upwards radially in the opposite direction such that the infant is disposed in the shell 2 and comfortably supported on the seat 3. The infant quickly learns to turn himself or herself relative to the shell 2 by rotating the turntable 3 using his or her arms and legs and this provides stimulation and feedback for the infant's immediate visual, tactile and oratory responses.

A kicking bar 5 is detachably mounted on ring 1 along a segment thereof. This enables the infant to engage it's feet with the bar 5 in order to pivot himself or herself on the turntable seat 3 around the concave support shell 2. Kicking pads and pillows 6 providing tactile and oratory stimulation are removably attached to the shell 2 as, for example, with Velcro or similar fasteners. Additionally within the contemplation of the invention are removable supports (not shown) for hand toys and the like which can be mounted on the ring 1.

The ring 1 is mounted on supports 7 at a number of angular locations to furnish stability for the infant play ring in its operative condition. The supports 7 can be foldable or detachable in order to provide a compact arrangement when the play ring is to be stored.

Although the invention has been described in conjunction with a specific embodiment thereof, it will become apparent to those skilled in the art that numerous modifications and variations of the disclosed embodiment can be made within the spirit and scope of the invention as defined by the attached claims.

What is claimed is:

1. An infant play ring comprising support means on which an infant can be disposed in supine position, said support means being of concave shape and having a central region in an arrangement such that the infant on the support means extends across the central region, and rotatable turntable means at said central region of the support means for supporting the infant with capability of rotating on said turntable relative to said support means in supine position, said support means comprising a shell of flexible material including a peripheral rim portion and a ring suspending said shell by said peripheral rim portion.

2. An infant play ring as claimed in claim 1 wherein said turntable means comprises a seat rotatably supported by said shell at the inner surface thereof.

3. An infant play ring as claimed in claim 2 wherein said seat comprises a member at the level of the inner surface of the shell, said member having an upper support surface on which the backside of the infant can be placed.

4. An infant play ring as claimed in claim 3 wherein said ring is circular.

5. An infant play ring as claimed in claim 3 wherein the upper surface of said member is flat.

6. An infant play ring as claimed in claim 3 comprising means on said upper surface of said shell for providing countersupport for the legs of the infant to enable the infant to rotate himself or herself around the support means on the turntable means.

7. An infant play ring as claimed in claim 3 comprising a kicking bar mounted on said ring along a segment thereof.

8. An infant play ring as claimed in claim 7 wherein said kicking bar is detachable.

9. An infant play ring comprising support means on which an infant can be disposed in supine position, said support means being of concave shape and having a central region in an arrangement such that the infant on the support means extends across the central region, rotatable turntable means at said central region of the support means for supporting the infant with capability of rotating on said turntable relative to said support means in supine position and kicking pads on said support means.

10. An infant play ring as claimed in claim 9 wherein said kicking pads are removable from said support means.

11. A method of providing visual, tactile and oratory response for an infant comprising placing an infant in supine position on a rotatable turntable with the legs and arms of the infant extending radially outside the turntable and providing a countersupport of concave shape on which the head and legs of the infant can rest such that the infant can spin himself or herself around the countersupport on the turntable in supine position.

12. A method as claimed in claim 11 wherein the turntable is relatively rigid and the countersupport is flexible as that the infant receives resilient counteraction by the countersupport.

* * * * *